US011155372B2

(12) United States Patent
Hoepner et al.

(10) Patent No.: US 11,155,372 B2
(45) Date of Patent: Oct. 26, 2021

(54) TRAY SEALING MACHINE AND METHOD FOR GENTLY PICKING UP A TRAY

(71) Applicant: MULTIVAC SEPP HAGGENMUELLER SE & CO. KG, Wolfertschwenden (DE)

(72) Inventors: Bernd Hoepner, Kempten (DE); Sebastian Fackler, Ottobeuren (DE); Peter Riegger, Wildpoldsried (DE); Thomas Magel, Wiggensbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 0 days.

(21) Appl. No.: 16/862,704

(22) Filed: Apr. 30, 2020

(65) Prior Publication Data

US 2020/0346801 A1 Nov. 5, 2020

(30) Foreign Application Priority Data

Apr. 30, 2019 (DE) ..... 102019206209.1

(51) Int. Cl.

| | |
|---|---|
| ***B65B 7/16*** | (2006.01) |
| ***B65B 43/46*** | (2006.01) |
| ***B65B 57/04*** | (2006.01) |
| ***B65B 65/02*** | (2006.01) |
| ***B65B 9/04*** | (2006.01) |
| ***B65B 31/02*** | (2006.01) |

(52) U.S. Cl.

CPC ..... *B65B 7/164* (2013.01); *B65B 9/04* (2013.01); *B65B 31/028* (2013.01); *B65B 43/46* (2013.01); *B65B 57/04* (2013.01); *B65B 65/02* (2013.01); *B65B 7/162* (2013.01)

(58) Field of Classification Search

CPC ..... B65B 7/162; B65B 7/164; B65B 9/04; B65B 11/52; B65B 31/028; B65B 43/46; B65B 57/04; B65B 65/02

USPC ..... 53/478, 329.2, 329.3, 453, 559

See application file for complete search history.

(56) References Cited

U.S. PATENT DOCUMENTS

| | | | | |
|---|---|---|---|---|
| 5,475,965 | A | 12/1995 | Mondini | |
| 6,834,476 | B2 * | 12/2004 | Konishi | B65B 7/164 53/329.5 |
| 9,221,604 | B2 | 12/2015 | Takagawa | |
| 9,346,576 | B2 | 5/2016 | Allgaier et al. | |
| 9,376,268 | B2 | 6/2016 | Schiavina | |
| 10,144,539 | B2 | 12/2018 | Lang et al. | |

(Continued)

FOREIGN PATENT DOCUMENTS

| | | | |
|---|---|---|---|
| CN | 86102243 | A | 10/1987 |
| CN | 1495118 | A | 5/2004 |

(Continued)

OTHER PUBLICATIONS

European Search Report dated Oct. 15, 2020, Application No. 20170678.5-1016, Applicant Multivac Sepp Haggenmueller SE & Co. KG, 5 Pages.

(Continued)

*Primary Examiner* — Stephen F. Gerrity

(74) *Attorney, Agent, or Firm* — Brooks Kushman P.C.

(57) ABSTRACT

The present disclosure relates to a tray sealing machine and, in addition, to a method for gently picking-up trays and for gently depositing sealed packages.

17 Claims, 8 Drawing Sheets

(56) References Cited

U.S. PATENT DOCUMENTS

| | | | |
|---|---|---|---|
| 10,661,932 | B2 | 5/2020 | Mader et al. |
| 2006/0120914 | A1 | 6/2006 | Salda |
| 2012/0013138 | A1 | 1/2012 | Ickert |
| 2018/0155074 | A1 | 6/2018 | Gabler et al. |

FOREIGN PATENT DOCUMENTS

| | | | | |
|---|---|---|---|---|
| CN | 1812817 | A | 8/2006 | |
| CN | 102143899 | A | 8/2011 | |
| CN | 104271477 | A | 1/2015 | |
| CN | 106494682 | A | 3/2017 | |
| DE | 2038309 | A1 * | 2/1971 | ..... B65B 7/164 |
| DE | 691 01 374 | T2 | 6/1994 | |
| DE | 695 05 877 | T2 | 5/1999 | |
| DE | 10 2008 030 510 | A1 | 1/2010 | |
| DE | 20 2009 009 242 | U1 | 11/2010 | |
| DE | 10 2016 123 569 | A1 | 6/2018 | |
| EP | 2 407 388 | A1 | 1/2012 | |
| EP | 2634100 | A1 | 9/2013 | |
| EP | 2 883 684 | A1 | 6/2015 | |
| EP | 3 070 012 | A1 | 9/2016 | |
| FR | 2449597 | A1 | 9/1980 | |
| JP | 2007099339 | A | 4/2007 | |
| WO | 92/10405 | A2 | 6/1992 | |
| WO | 2011/041320 | A2 | 4/2011 | |

OTHER PUBLICATIONS

German Search Report for DE 10 2019 206 2091 dated Jan. 31, 2020 (with English Machine Translation), Applicant Multivac Sepp Haggenmueller SE & Co. KG, 14 Pages.

Chinese Office Action (with English Translation) dated Jul. 12, 2021, Application No. 202010356825.2, 15 Pages.

* cited by examiner

TRAY SEALING MACHINE AND METHOD FOR GENTLY PICKING UP A TRAY

CROSS-REFERENCE TO RELATED APPLICATIONS

This application claims foreign priority benefits under 35 U.S.C. § 119(a)-(d) to German patent application number DE 10 2019 206 209.1, filed Apr. 30, 2019, which is incorporated by reference in its entirety.

TECHNICAL FIELD

The present disclosure relates to a tray sealing machine. In addition, the present disclosure relates to a method of lifting and lowering a tray holder at a sealing station of a tray sealing machine.

BACKGROUND

On known tray sealing machines, which are also referred to as tray sealers in practice, it is a technical challenge to gently pick up, within short conveying cycles, the trays, which are filled with products and provided for a sealing process, within a sealing station by a tray holder and to then gently place them onto a support plate unit subsequent to the sealing process.

In particular in the case of trays with pasty, liquid or loose products, an excessively abrupt picking-up of trays may have the effect that such products are partially flung out of or spilled out of the tray.

Also, when already closed packages are deposited, tilting or tumbling should be avoided, so that a gripper working functionally on the tray sealing machine will be able to grip the packages as precisely and quickly as possible for further conveyance. This, however, necessitates that the packages are provided to the gripper such that they are precisely positioned at a predetermined position, in particular in a stationary condition.

DE 69 01 374 T2; discloses a motor-driven lifting mechanism of a packaging machine, in the case of which the lifting speed can be changed during the movement.

Against the background of the above-mentioned technical challenges, it is the object of the present disclosure to improve a tray sealing machine as well as a method, making use of the simplest possible structural means in order to ensure gentle and efficient tray conveyance within a sealing station. In addition, the disclosure should be realizable at a reasonable cost.

SUMMARY

/MN The present disclosure relates to a tray sealing machine comprising at least one feed unit for conveying trays in a production direction, a sealing station arranged downstream of the feed unit, when seen in the production direction, and used for producing packages, at least one discharge unit arranged downstream of the sealing station, when seen in the production direction, as well as a gripper unit. The gripper unit is configured to pick up trays provided on the feed unit and convey them into the sealing station for a tray sealing process taking place in the sealing station as well as to pick up packages produced within the sealing station and convey them to the discharge unit, in a conveying cycle.

The sealing station comprises a tool upper part, which includes a sealing tool, as well as a tool lower part including a support plate unit for depositing thereon the trays conveyed into the sealing station and a vertically adjustable tray holder for picking up and conveying the trays, which have been transferred to the support plate unit, to the tool upper part.

The tray sealing machine additionally comprises a lifting and lowering mechanism (referred to hereinafter simply as lifting mechanism) configured to move the tray holder from a first position, at which the tray holder occupies a starting position in an open state of the sealing station, to a second position, at which the tray holder occupies a working position located closer to the tool upper part in a closed state of the sealing station, during a first predetermined motion sequence. The tray holder is adapted to be moved in the course of the first motion sequence by means of the lifting mechanism in such a way that the tray holder will pick up the trays, which are provided on the support plate unit, at a predetermined pick-up speed.

The features characterizing the disclosure are that the tray sealing machine is configured such that a local rate of speed change over time of the tray holder will have changed from a positive value to a negative value in the course of the first motion sequence before the tray holder has reached the predetermined pick-up speed, and/or that the tray holder is adapted to be moved, by means of the lifting mechanism, from the second position back to the first position in the course of a second predetermined motion sequence, which is provided for opening the sealing station, in such a way that the tray holder will transfer the produced packages accommodated therein to the support plate unit at a predetermined depositing speed, with a rate of speed change over time of the tray holder having changed from a negative value to a positive value in the course of the second motion sequence before the tray holder has reached the predetermined depositing speed. After the sealing process has been carried out, the tray holder, together with the sealed packages, is here lowered at the highest possible speed, and is then, in good time, decelerated to the speed level of the depositing speed, so that the packages produced can be deposited gently. In spite of the thus achieved fast lowering of the tray holder, it is nevertheless guaranteed that the packages will be deposited gently. It follows that, both during lifting of the tray holder and during lowering of the tray holder, an acceleration process is first carried out for optimizing the performance of the tray sealing machine and, subsequently, a deceleration process is carried out, so as to arrive at a depositing speed for transferring the packages gently. Hence, the lifting mechanism accelerates the tray holder at a comparatively fast rate in the direction of the trays and ensures that the tray holder is, in good time, decelerated to the speed level of the pick-up speed, which is higher than zero, so that the tray holder can pick up the trays gently.

According to the present disclosure, the tray holder is first accelerated from the first position during the first motion sequence to a speed above the speed level of the pick-up speed and is then decelerated to the predetermined pick-up speed, which is higher than zero, so as to pick up the trays gently by means of this speed. The trays are thus picked up immediately after the deceleration process. This means that the pick-up speed results directly from the deceleration process. The change of sign of the rate of speed change over time takes place between the acceleration process and the deceleration process above the speed level of the pick-up speed.

The acceleration process, which first takes place during the first motion sequence and in the course of Which the speed of the tray holder increases continuously until the deceleration process starts, causes the desired performance optimization of the operation of the tray sealing machine in the case of the present disclosure. The deceleration process following the acceleration process during the first motion sequence has the effect that the tray bolder will reach a suitable pick-up speed allowing gentle picking up of the trays provided.

Preferably, the local rate of speed change over time of the tray holder changes during the first motion sequence from a positive value to a negative value precisely once before the tray bolder has reached the predetermined pick-up speed as a result of the deceleration process. In other words, during the lifting movement, the speed of the tray holder is, during the first motion sequence, first increased continuously up to a predetermined speed, Which is higher than the pick-up speed, and, when the predetermined speed has been reached, it is reduced continuously down to the pick-up speed.

According to the present disclosure, the lifting mechanism already used for the tray holder at the sealing station can easily be controlled by means of a controller of the tray sealing machine, so as to coordinate the tray holder motion sequence according to the present disclosure. It would be imaginable that, as regards different types of trays, respective path curves for the first and/or the second motion sequence are stored for the tray holder and can be retrieved, and that the gentle picking up of trays as well as the gentle deposition of finished packages can be controlled on the basis of these path curves.

Preferably, the tray holder, together with the trays accommodated therein, can be moved at the pick-up speed for a predetermined time interval. The trays can thus be received by the tray holder with high positioning accuracy and in a stationary manner.

According to an advantageous embodiment, the tray sealing machine is configured such that the rate of speed change over time of the tray holder, including the trays accommodated therein, will have changed from a positive value to a negative value during the first motion sequence before the tray holder has arrived at the second position. Just as during the approach to the provided trays, the tray holder, together with the trays, after having picked up the trays, accelerates to a predetermined speed, preferably to a maximum speed of the lifting process, according to this variant, before it is then decelerated, in good time, prior to reaching the second position, i.e., the working position for carrying out a sealing process. This acceleration and deceleration sequence results in shorter conveying cycles of the trays, which have been picked up by means of the tray holder, to the sealing tool.

Preferably, the tray holder is movable at the depositing speed for a predetermined time interval from a transfer moment, at which the packages have been transferred to the support plate unit. This allows the packages to be deposited carefully and in a precisely positioned manner at predetermined positions onto the support plate unit.

Preferably, the tray sealing machine is configured such that the rate of speed change over time of the tray holder will have changed from a negative value to a positive value during the second motion sequence after the packages have been transferred to the support plate unit at the depositing speed and before the tray holder has returned to the first position. This allows the tray holder to return, after having transferred the packages to the support plate unit, to its starting position at maximum speed, so as to be able to pick up again, within a short period of time, provided trays for a subsequent tray sealing process.

As regards control technology, the necessary effort can be minimized when the first motion sequence and the second motion sequence are substantially symmetrical. It would be imaginable that the second motion sequence comprises higher accelerations than the first motion sequence, since the packages have already been closed here.

For processing different types of trays, it will be advantageous when the pick-up speed and/or the depositing speed are variably adjustable at the tray sealing machine.

Preferably, the tray sealing machine is configured such that the tray holder will reach the pick-up speed at a predetermined pick-up position in the course of the first motion sequence, before the trays provided on the support plate unit are received, on tray edges formed thereon, by the tray holder. Here, it would be imaginable that means formed on the tray holder for receiving the respective trays are still approximately 2.5 mm away from the tray edges when the tray holder has arrived at the pick-up position, i.e., when the tray holder has been decelerated to the predetermined pick-up speed.

According to a variant, the tray sealing machine is configured such that the tray holder will reach the depositing speed at a predetermined depositing position during the second motion sequence before the packages have been deposited on the support plate unit by means of package bases formed thereon. It is imaginable that the tray holder has arrived at the predetermined depositing position, when the package bases of the trays accommodated in the tray holder are positioned approximately 2.5 mm above reception plates provided on the support plate unit.

A sealing process can be carried out advantageously, in particular when the sealing tool is supported in a vertically adjustable manner within the tool upper part. The sealing station is preferably configured to carry out an evacuation and/or gas-flushing process so as to generate a desired atmosphere in the interior of the packages.

According to a cost-effective and simple embodiment of the tray sealing machine, the support plate unit, and in particular the support plates formed thereon, is/are mounted stationarily on the sealing station. According to the present disclosure, gentle picking up of the trays and gentle depositing of the sealed packages is achieved by the special stroke movement carried out by means of the lifting mechanism on the sealing station, the lifting mechanism being used for the tray holder. This means that it will not be necessary to provide at the tray sealing machine according to the present disclosure an additional lifting mechanism for the support plate unit.

The present disclosure also relates to a method of lifting and lowering a tray holder at a sealing station of a tray sealing machine. When the tray holder is being lifted, trays, which are provided on a support plate unit, are picked-up by means of the tray holder according to this method and conveyed to a tool upper part positioned above the tray holder, so as to carry out a tray sealing process. The tray holder is moved by means of a filling mechanism from a first position, at which the tray holder occupies a starting position in an open state of the sealing station, to a second position, at which the tray holder occupies a working position located closer to the tool upper part in a closed state of the sealing station, during a first predetermined motion sequence, the tray holder picking up the trays, which are provided on the support plate unit, at a predetermined pick-up speed.

According to the present disclosure, a rate of speed change over time of the tray holder changes from a positive value to a negative value during the first motion sequence before the tray holder reaches the predetermined pick-up speed, and/or, subsequent to a tray sealing process, the tray holder is moved by means of the lifting mechanism from the second position back to the first position in the course of a second predetermined motion sequence in such a way that the tray holder will transfer, at a predetermined depositing speed, produced, i.e., sealed, packages accommodated therein to the support plate unit, with a rate of speed change over time changing from a negative value to a positive value during the second motion sequence before the tray holder reaches the predetermined depositing speed. The acceleration of the tray holder from the second position is here first carried out until a predetermined, in particular maximum lowering speed has been reached, Afterwards, but before the packages accommodated in the tray holder are transferred, the tray holder will be decelerated down to a speed level corresponding to the predetermined depositing speed, on the basis of which the tray holder will gently transfer the packages to the support plate unit. Just as during the lifting movement of the tray holder, it will thus be possible to realize also during the lowering movement of the tray holder a shorter stroke time for optimizing the performance of the tray sealing machine, and, simultaneously, a gentle deposition of the closed packages. According to the present disclosure, the tray holder is first accelerated to a speed level above the pick-up speed and is then decelerated, so as to arrive at the predetermined pick-up speed on the basis of which the provided trays can be picked up gently by the tray holder. The acceleration and deceleration of the tray holder causes a performance-optimized movement of the tray holder as well as gentle picking up of the trays by means of the latter.

LOOM Preferably, from a moment in time at which the trays have been received by the tray holder, the tray holder will be lifted at the pick-up speed for a predetermined time interval. This ensures that the trays picked up by means of the tray holder can assume their exact position on the tray holder before they are lifted still further.

According to an advantageous variant, the rate of speed change over time of the tray holder, including the trays accommodated therein, will change from a positive value to a negative value during the first motion sequence before the tray holder has arrived at the second position. After having received the trays therein, the tray holder is here accelerated still further up to a predetermined speed level, preferably up to a maximum lifting speed, and is then decelerated until it arrives at the second position, i.e., until it will stand still, whereby a particularly fast displacement movement of the tray holder towards the tool upper part is accomplished.

The sealed packages can be transferred to the support plate unit with a particularly high positioning accuracy when, from a transfer moment, at which the packages have been transferred to the support plate unit, the tray holder will be lowered still further at the depositing speed for a predetermined time interval.

A fast return to the first position of the tray holder will be more easily accomplished, when the rate of speed change over time of the tray holder changes during the second motion sequence from a negative value to a positive value after the packages have been transferred to the support plate unit at the depositing speed and before the tray holder has returned to the first position.

BRIEF DESCRIPTION OF THE DRAWINGS

The present disclosure will be described on the basis of an embodiment in the following figures, in which.

The technical features shown in the figures are provided with like reference numerals throughout the application.

DETAILED DESCRIPTION

Figure 1:
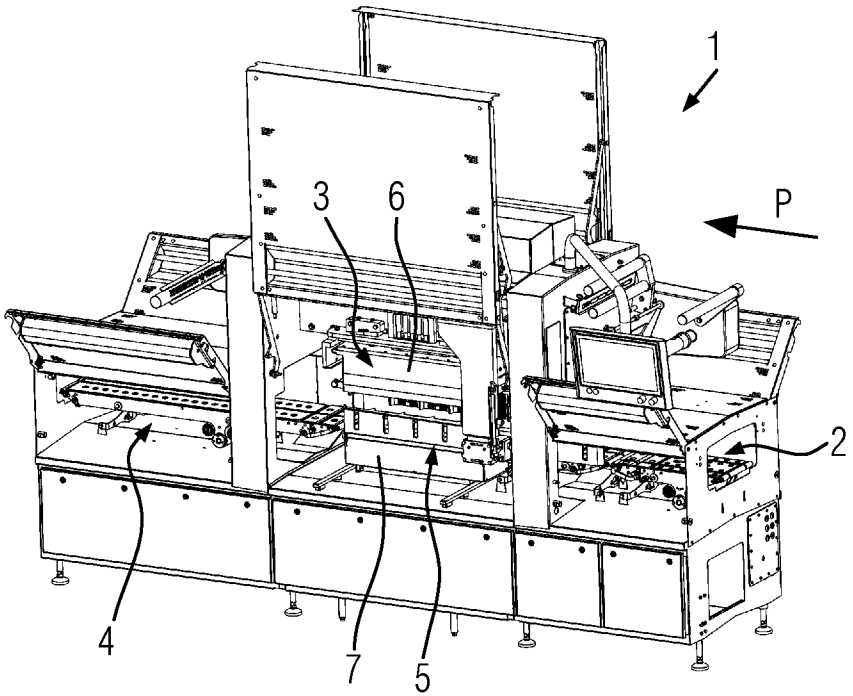
FIG. 1 shows a tray sealing machine according to the present disclosure.

FIG. 1 shows a tray sealing machine 1. The tray sealing machine 1 is configured as a so-called tray sealer. The tray sealing machine 1 comprises a feed unit 2 for conveying trays T in a production direction P, the trays T being shown e.g., in FIG. 2A. A sealing station 3 used for producing packages V is arranged downstream of the feed unit 2, when seen in the production direction P. The packages V are produced by a tray sealing process S according to FIG. 2F.

In addition, FIG. 1 shows a discharge unit 4 arranged downstream of the sealing station. 3, When seen in the production direction P, and used for discharging the packages V produced. The tray sealing machine 1 according to FIG. 1 additionally comprises a gripper unit 5 configured for—in a conveying cycle—picking up trays T provided on the feed unit 2 and conveying them into the sealing station 3 for the tray sealing process S taking place in the latter. In addition, the gripper unit 5 is configured for picking up packages V produced within the sealing station 3 and for conveying them to the discharge unit 4. According to FIG. 1, the sealing station 3 has a tool upper part 6 as well as a tool lower part 7.

Figure 2A:
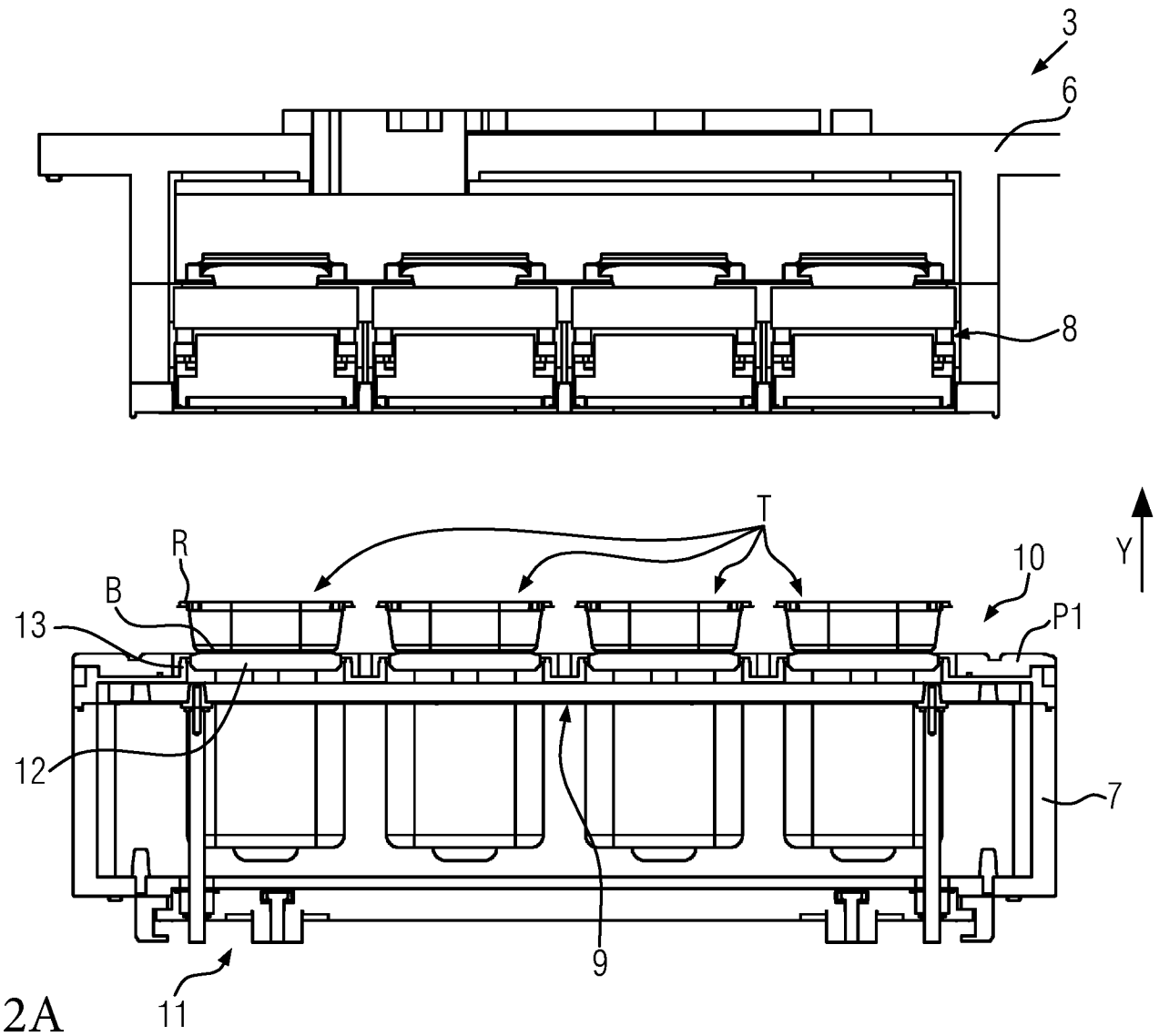
FIG. 2A shows an open sealing station having the trays provided therein.

FIG. 2A shows the sealing station 3 isolated from FIG. 1 in a schematic sectional view. The sealing station 3 is in an open state in FIG. 2A. The tool lower part 7 is positioned below the tool upper part 6 in spaced relationship therewith. The tool upper part 6 comprises a sealing tool 8. The tool lower part 7 provides a support plate unit 9, which is used for placing thereon the trays T conveyed into the sealing station 3. In addition, the tool lower part 7 comprises a tray holder 10 supported in a vertically adjustable manner and used for picking up and conveying the trays T deposited on the support plate unit 9 to the tool upper part 6 positioned thereabove.

FIG. 2A additionally shows a lifting mechanism 11 configured for moving the tray holder 10 from a first position P1 shown in FIG. 2A to a second position P2, which will be described hereinafter in connection with FIGS. 2E and 2F. At the first position P1, the tray holder 10 is supported at a starting position in the open state of the sealing station 3. At the second position P2, the tray holder 10 occupies a working position located closer to the tool upper part 6 in the closed state of the sealing station 3. At the working position, an evacuation, gas flushing and/or sealing process can be carried out.

In FIG. 2A, four trays T are arranged side by side or, when seen in the production direction P, one after the other on the support plate unit 9. The support plate unit 9 is provided with support plates 12, on which tray bases B of the respective trays T rest. The tray holder 10 is lifted by means of the lifting mechanism 11 and has reception units 13 receiving the tray edges R of the trays T provided. The tray holder 10 is lifted vertically along a direction Y to pick up the trays T provided.

Figure 2B:
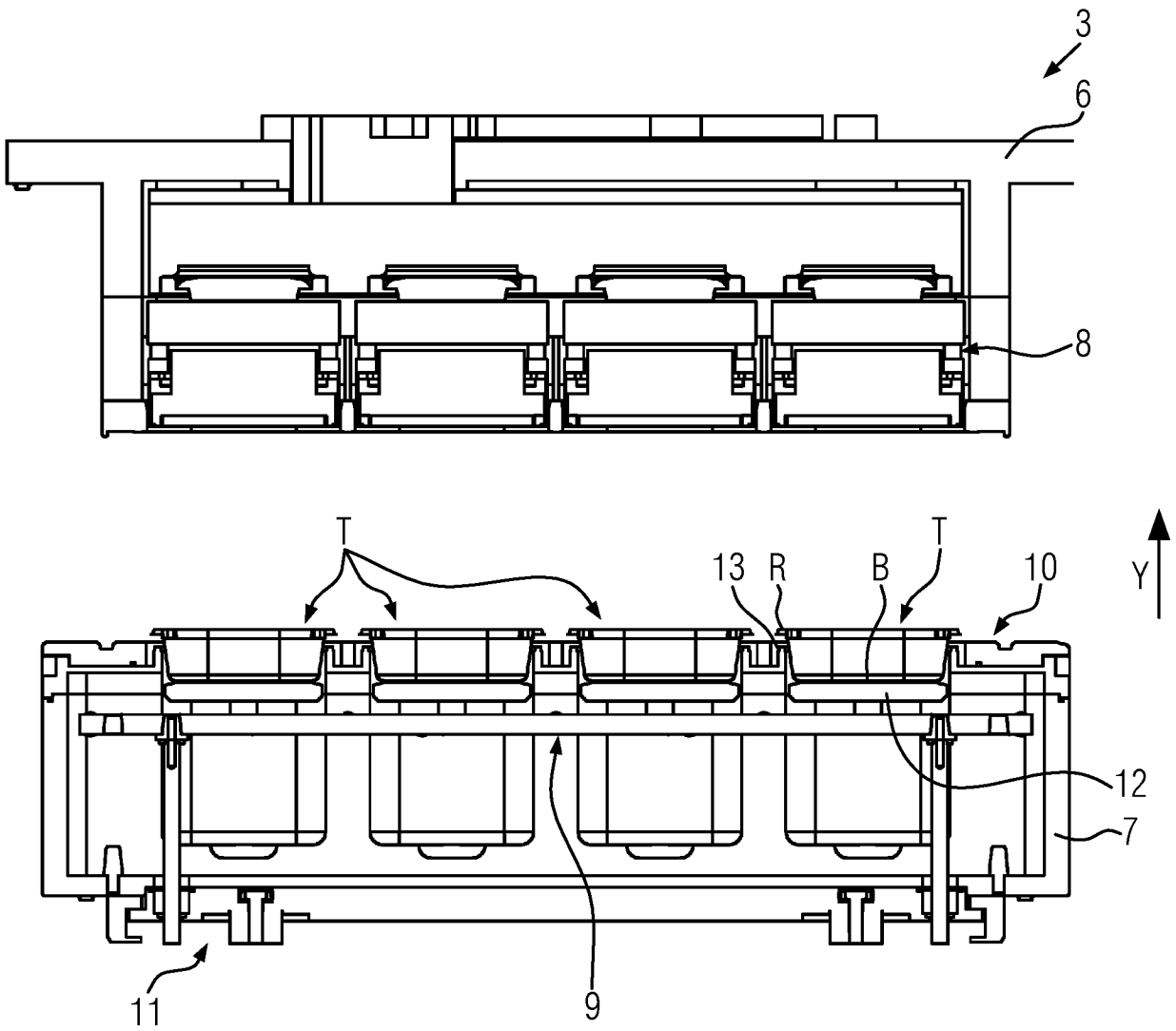
FIG. 2B shows tray holder lifting relative to the stationarily arranged support plate unit.

FIG. 2B shows the sealing station 3 with a tray holder 10 raised above its original level shown in FIG. 2A. In FIG. 2B, the respective reception units 13 have approached the tray edges R of the trays T. However, the individual trays T still rest on the respective support plates 12 of the support plate unit 9 with the tray bases 13 formed thereon.

Figure 2C:
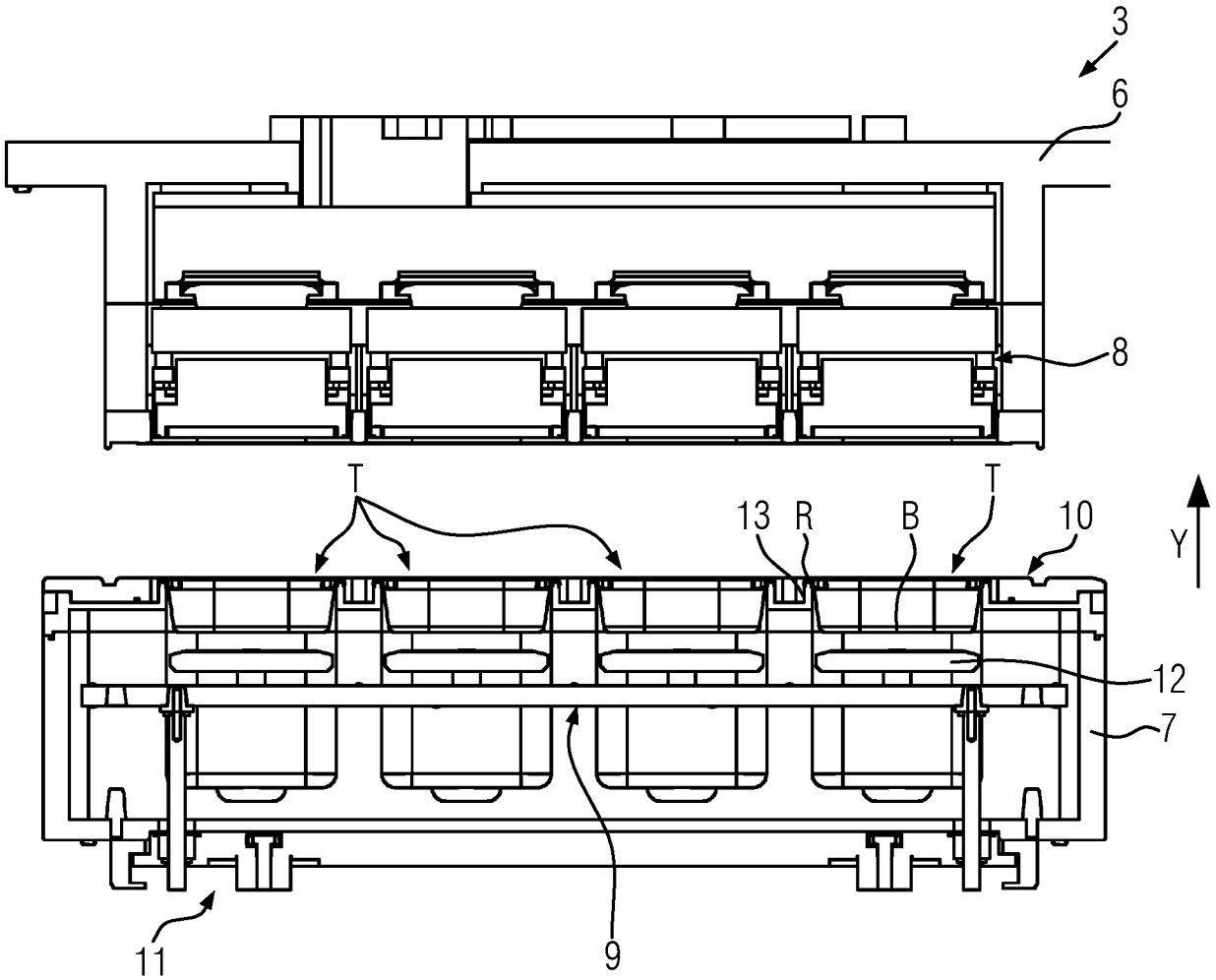
FIG. 2C shows trays carried along by the tray holder, so as to lift the trays for a sealing process.
Figure 2D:
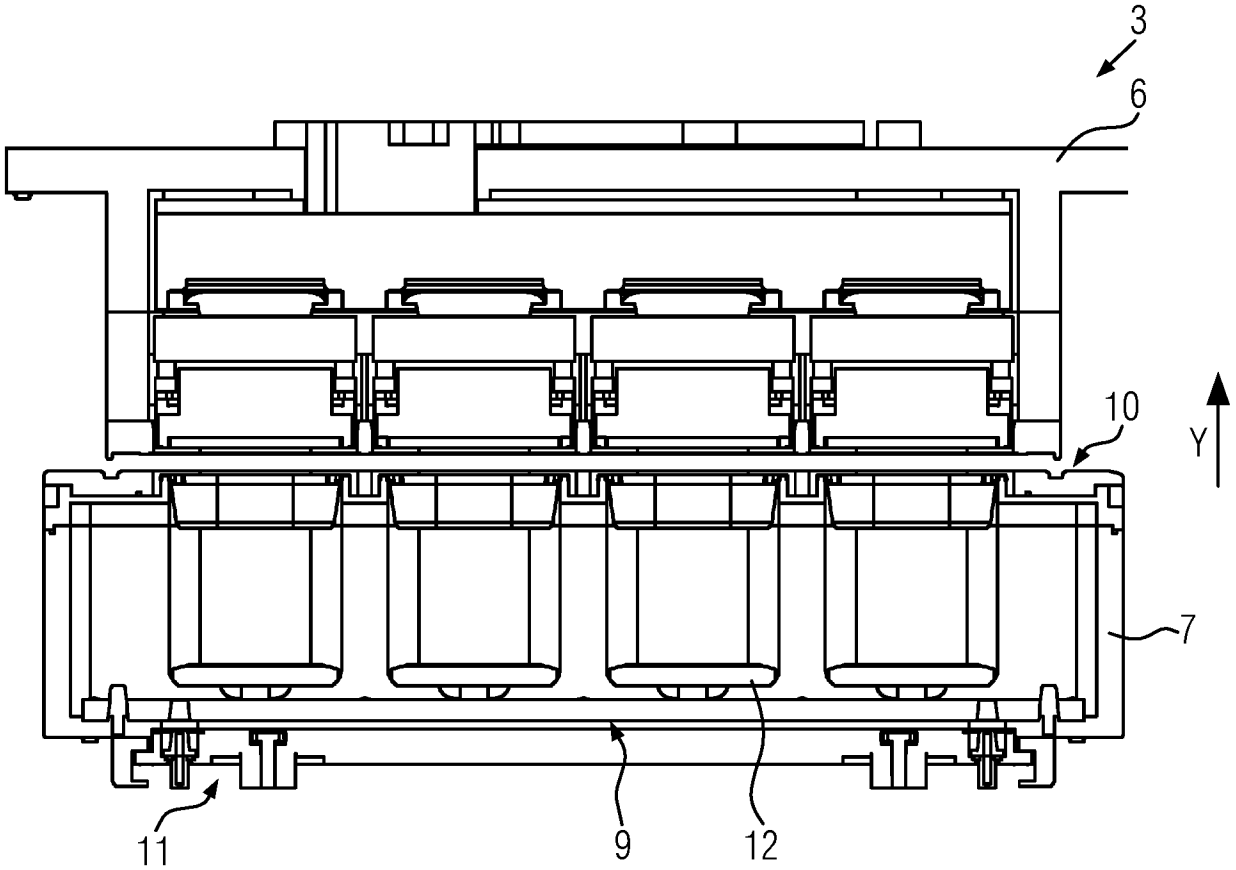
FIG. 2D shows tray lifting, by means of the tray holder towards the tool upper part of the sealing station arranged thereabove.

FIG. 2C shows the vertically adjustable tray holder 10 with trays T accommodated in the reception units 13 formed on the tray holder 10. The respective trays T now no longer rest on the support plate unit 9. FIG. 2D shows the tray holder 10 at a position raised still further, just before the sealing station 3 is closed, FIG. 2E shows the tray holder 10 at the second position P2, where the tray holder 10 occupies a working position located closer to the tool upper part 6 in the closed state of the sealing station 3. The sealing station 3 is now in a hermetically sealed state, so as to execute optionally an evacuation and/or a gas-flushing process within a chamber formed therein.

Figure 2E:
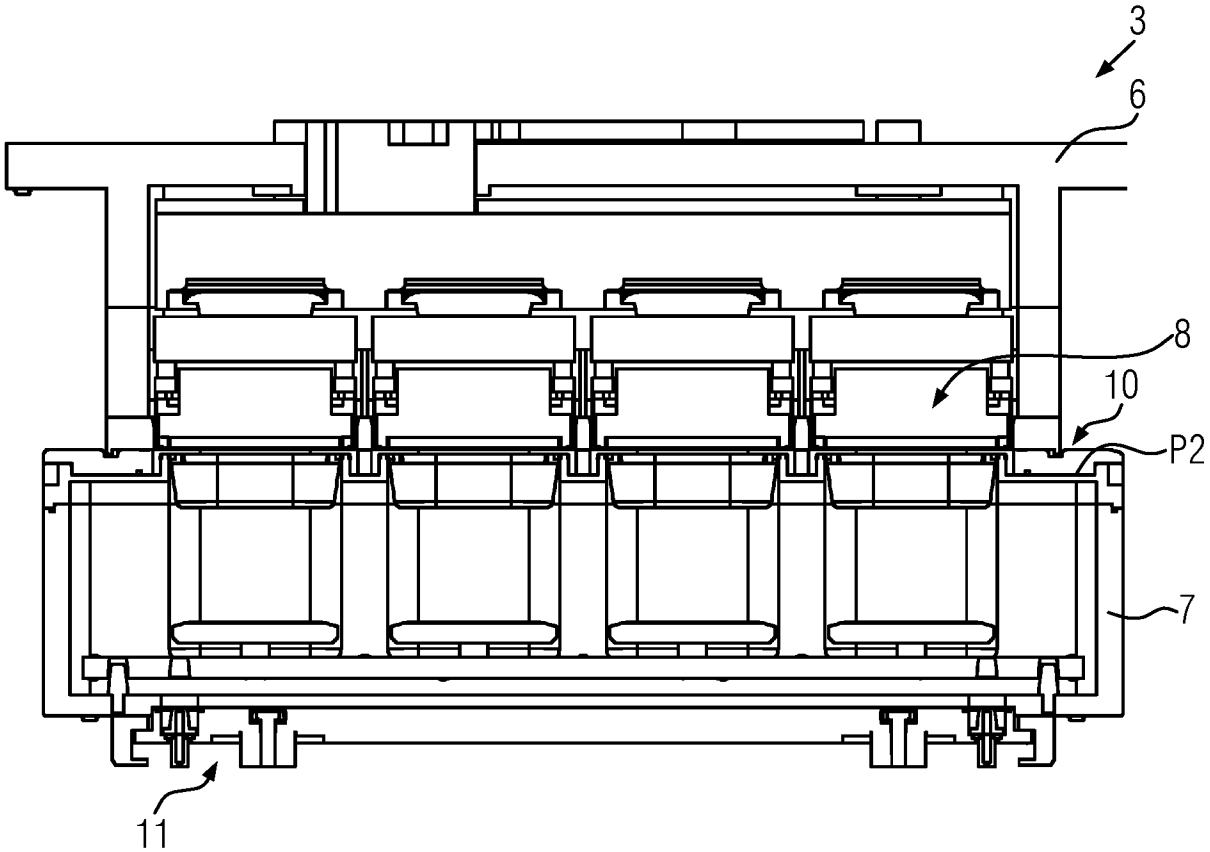
FIG. 2E shows a representation of the sealing station in the closed state.
Figure 2F:
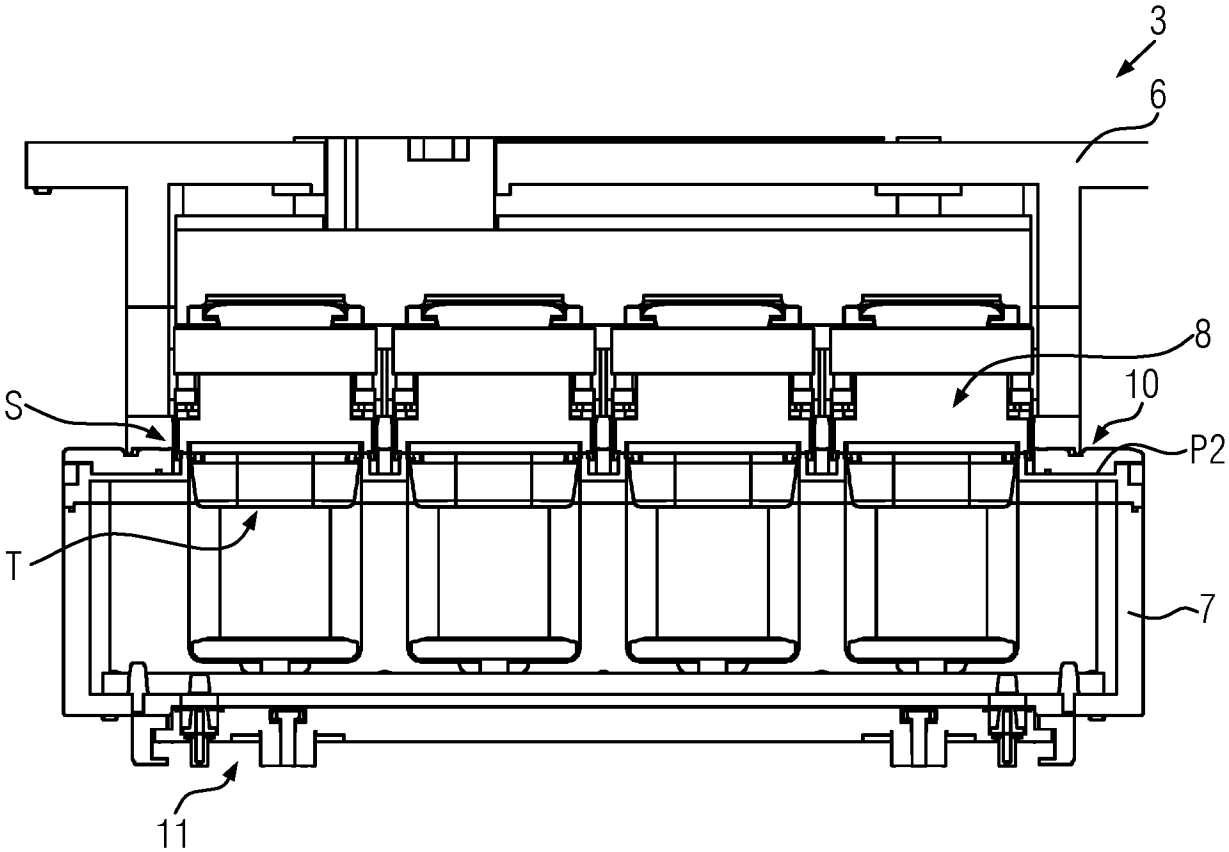
FIG. 2F shows a representation of the sealing station daring the tray closing process for sealing the trays provided in the tray holder.

The sealing tool 8 is lowered from the position shown in FIG. 2E to the position shown in FIG. 2F so as to close the trays T provided in the tray holder 10 by means of a top film, which is not shown, (tray sealing process S). In so doing, the top film is sealed, along the tray edges R, onto the trays T provided. Subsequently, the packages V are separated from one another within the sealing station 3.

FIG. 2A to 2F show a closing process in the sealing station 3, the tray holder 10 being moved from the first position P1 up to and into the second position. P2, where the tray sealing process S can take place on trays accommodated in the sealing station 3. When the respective trays T provided by means of the tray holder 10 have been sealed, they are conveyed back to the support plate unit 9 by means of the tray holder 10. In so doing, the tray holder 10 returns to the first position P1, so that the gripper unit 5 shown in FIG. 1 can collect the sealed packages V, Which are placed on the support plate unit 9, and convey them to the discharge unit 4.

Figure 3:
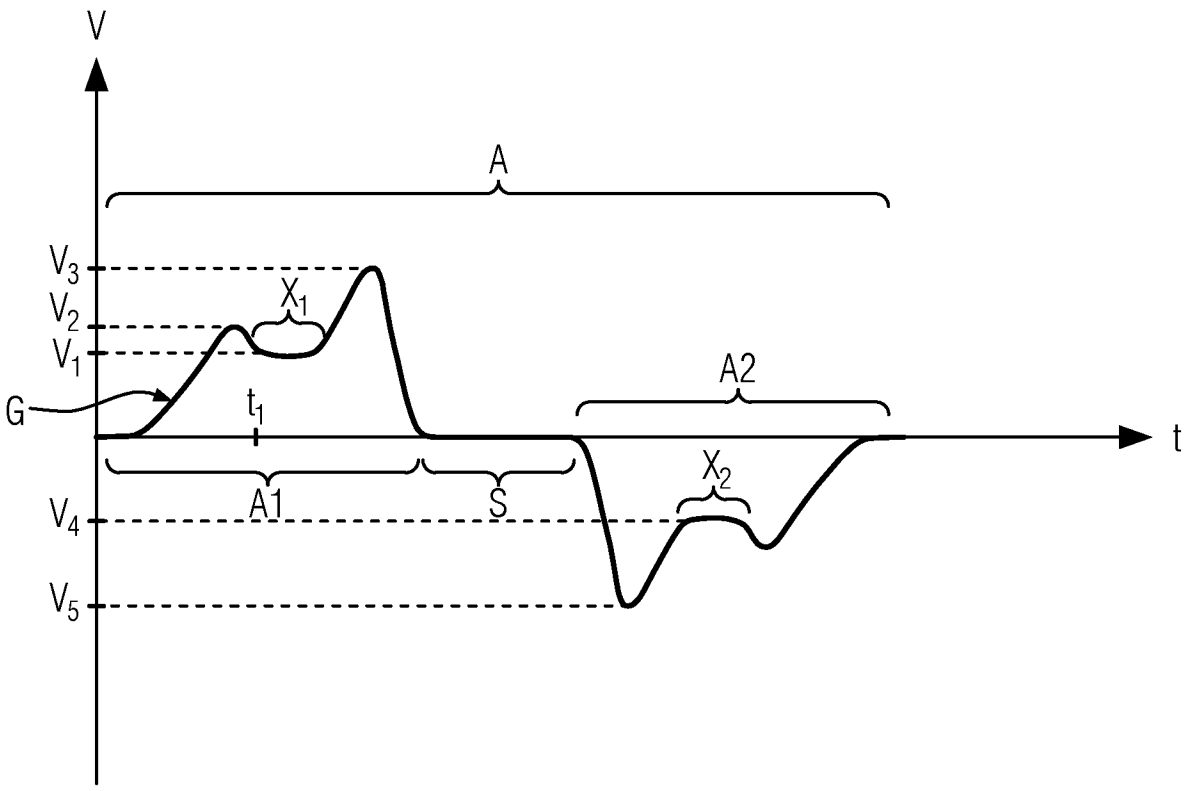
FIG. 3 shows a schematic motion sequence of the tray holder during closing and opening of the sealing station used on the tray sealing machine.

FIG. 3 shows a motion sequence. A that can be used to lift and lower the tray holder 10 so as to close and open the sealing station 3. The motion sequence A comprises a first predetermined motion sequence A1, the velocity curve of which is used for illustrating the lifting of the tray holder 10 from the first position P1, at which the tray holder 10 occupies the starting position in an open state of the sealing station 3, to the second position P2, at which the tray holder 10 occupies the working position located closer to the tool upper part 6 in a closed state of the sealing station. Making use of the lifting mechanism 11, the tray holder 10 can be moved during the first motion sequence A1 such that the tray holder 10 will collect the trays 1, which have been provided on the support plate unit 9, at a predetermined pick-up speed v1 at a moment in time t1.

FIG. 3 shows that the tray holder 10 is first accelerated during the motion sequence A1 up to an approach speed v2 and is then, when the approach speed v2 has been reached, decelerated down to the pick-up speed v1. The magnitude of the approach speed v2 exceeds that of the pick-up speed v1. In the course of the first motion sequence A1, the tray holder 10 is thus first accelerated up to a speed level above the pick-up speed v1 and then decelerated down to the pick-up speed v1 before the trays 71' are received therein at the pick-up speed v1. In FIG. 3, during the first motion segment A1, local rate of speed change G over time changes, before the trays T are received by the tray holder 10, from a positive value to a negative value before the tray holder 10 has reached the predetermined pick-up speed v1.

As soon as the trays T have been received by the tray holder 10, the tray holder 10 in FIG. 3 will move during a time, interval X1 at an almost constant speed, i.e., essentially at the pickup speed v1.

In addition, FIG. 3 shows that, after the trays 1' have been picked up, the tray holder 10 is, still during the first motion sequence A1, first accelerated and then decelerated, i.e., the rate of speed change G over time changes again from a positive value to a negative value before the tray holder 10 has arrived at the second position P2, i.e., the working position, at which the tray sealing process S takes place.

According to FIG. 3, the tray sealing process S takes place within a predetermined time interval. After the tray sealing process S, the sealing station 3 is opened again. In so doing, the tray holder 10 is moved during the second predetermined motion sequence A2 from the second position P2 back to the first position P1 by means of the lifting mechanism 11.

When the tray holder 10 is being lowered, the rate of speed change G over time of the tray holder 10 is changed from a negative value to a positive value during the second motion sequence A2 before the tray holder 10 has reached a predetermined depositing speed v4. FIG. 3 shows that the lifting and lowering of the tray holder 10 takes place in a substantially positionally symmetrical manner.

Before the depositing speed v4 shown in FIG. 3 has been reached, the tray holder 10 has executed acceleration up to a maximum lowering speed v5, from which the tray holder 10 is decelerated down to the depositing speed v4. After having reached the depositing speed v4, the tray holder 10 is constantly advanced during a time interval X2 at the depositing speed v4, so as to gently deposit the produced packages V on the support plate unit 9. After having passed through the time interval X2, the tray holder 10 is accelerated again and then decelerated, so that it will return quickly to the first position P1. The packages V are then collected from the support plate unit 9 by means of the gripper unit 5 shown in FIG. 1 and transferred to the discharge unit 4. At the same time, the gripper unit 5 can deposit new trays on the support plate unit 9. Subsequently, conveyance of the trays is repeated according to motion sequence A, so as to produce new trays.

The motion sequence A shown in FIG. 3 for the tray holder 10 of the sealing station 3 has the technical effect that the trays T can be picked up gently by means of the tray holder 10 and that the sealed packages V can also be deposited gently by means of the tray holder 10. The set motion sequence A also ensures rapid conveyance of the trays within the sealing station 3, so that the tray sealing machine 1 according to the present disclosure will be able to convey trays and sealed packages efficiently, i.e., within shorter conveying cycles.

What is claimed is:

1. A tray sealing machine comprising at least one feed unit for conveying trays in a production direction, a sealing station arranged downstream of the feed unit, when seen in the production direction, and used for producing packages, at least one discharge unit arranged downstream of the sealing station, when seen in the production direction, as well as a gripper unit configured to, in a conveying cycle, pick up trays provided on the feed unit and convey them into the sealing station for a tray sealing process taking place in the sealing station as well as pick up packages produced within the sealing station and convey them to the discharge unit, wherein the sealing station comprises a tool upper part, which includes a sealing tool, as well as a tool lower part, which includes a support plate unit for depositing thereon the trays conveyed into the sealing station and a vertically adjustable tray holder for picking up and conveying the trays transferred to the support plate unit towards the tool upper part, the tray sealing machine additionally comprising a lifting mechanism configured to move the tray holder from a first position, at which the tray holder occupies a starting position in an open state of the sealing station, to a second position, at which the tray holder occupies a working position located closer to the tool upper part in a closed state of the sealing station, during a first predetermined motion sequence, the tray holder being adapted to be moved during the first motion sequence by means of the lifting, mechanism in such a way that the tray holder will pick up the trays, which are provided on the support plate unit, at a predetermined pick-up speed, wherein the tray holder is adapted to be moved, by means of the lifting mechanism, from the second position back to the first position during a second predetermined motion sequence, which is provided for opening the sealing station, in such a way that the tray holder will transfer the produced packages accommodated therein to the support plate unit at a predetermined depositing speed, with a rate of speed change over time of the tray holder having changed from a negative value to a positive value during the second motion sequence before the tray holder has reached the predetermined depositing speed.

2. The tray sealing machine according to claim 1, wherein from a transfer moment, at which the packages have been transferred to the support plate unit, the tray holder is movable at the depositing speed for a predetermined time interval.

3. The tray sealing machine according to claim 1, wherein the tray sealing machine is configured such that the rate of speed change over time of the tray holder will have changed from a negative value to a positive value during the second motion sequence after the packages have been transferred to the support plate unit at the depositing speed and before the tray holder has returned to the first position.

4. The tray sealing machine according to claim 1, wherein the pick-up speed and/or the depositing speed are variably adjustable at the tray sealing machine.

5. The tray sealing machine according to claim 1, wherein the tray sealing machine is configured such that the tray holder will reach the pick-up speed at a predetermined pick-up position during the first motion sequence, before the trays provided on the support plate unit have been received, on tray edges formed thereon, by the tray holder.

6. The tray sealing machine according to claim 1, wherein the tray sealing machine is configured such that the tray holder will reach the depositing speed at a predetermined depositing position during the second motion sequence before the packages have been deposited on the support plate unit by means of package bases formed thereon.

7. The tray sealing machine according to claim 1, wherein the tray holder, together with the trays accommodated therein, is movable at the pick-up speed for a predetermined time interval.

8. The tray sealing machine according to claim 1, wherein the tray sealing machine is configured such that a rate of speed change over time of the tray holder will have changed from a positive value to a negative value during the first motion sequence before the tray holder has reached the predetermined pick-up speed.

9. The tray sealing machine according to claim 8, wherein the tray sealing machine is configured such that the rate of speed change over time of the tray holder, including the trays accommodated therein, will have changed from a positive value to a negative value during the first motion sequence before the tray holder arrived at the second position.

10. A method of lifting and lowering a tray holder at a sealing station of a tray sealing machine, wherein, when the tray holder is being lifted, trays, which are provided on a support plate unit, are picked-up by means of the tray holder and conveyed to a tool upper part positioned above the tray holder, so as to carry out a tray sealing process, wherein the tray holder is moved by means of a lifting mechanism from a first position, at which the tray holder occupies a starting position in an open state of the sealing station, to a second position, at which the tray holder occupies a working position located closer to the tool upper part in a closed state of the sealing station, during a first predetermined motion sequence, wherein the tray holder picks up the trays, which are provided on the support plate unit, at a predetermined pick-up speed, wherein subsequent to a tray sealing process, the tray holder is moved by means of the lifting mechanism from the second position back to the first position during a second predetermined motion sequence in such a way that the tray holder will transfer, at a predetermined depositing speed, produced packages accommodated therein to the support plate unit, with a rate of speed change over time changing from a negative value to a positive value during the second motion sequence before the tray holder reaches the predetermined depositing speed.

11. The method according to claim 10, wherein from a transfer moment, at which the packages have been transferred to the support plate unit, the tray holder is lowered still further at the depositing speed for a predetermined time interval.

12. The method according to claim 10, wherein the rate of speed change over time of the tray holder changes during the second motion sequence from a negative value to a positive value after the packages have been transferred to the support plate unit at the depositing speed and before the tray holder has returned to the first position.

13. The method according to claim 10, wherein from a moment, at which the trays have been received by the tray holder, the tray holder is lifted at the pick-up speed for a predetermined time interval.

14. The method according to claim 10, wherein a rate of speed change over time of the tray holder changes from a positive value to a negative value during the first motion sequence before the tray holder reaches the predetermined pick-up speed.

15. The method according to claim 14, wherein the rate of speed change over time of the tray holder, including the trays accommodated therein, will change from a positive value to a negative value during the first motion sequence before the tray holder arrives at the second position.

16. A tray sealing machine comprising at least one feed unit for conveying trays in a production direction, a sealing station arranged downstream of the feed unit, when seen in the production direction, and used for producing packages, at least one discharge unit arranged downstream of the sealing station, when seen in the production direction, as well as a gripper unit configured to, in a conveying cycle, pick up trays provided on the feed unit and convey them into the sealing station for a tray sealing process taking place in the sealing station as well as pick up packages produced within the sealing, station and convey them to the discharge unit, wherein the sealing station comprises a tool upper part, which includes a sealing tool, as well as a tool lower part, which includes a support plate, unit for depositing thereon the trays conveyed into the sealing station and a vertically adjustable tray holder for picking up and conveying the trays transferred to the support plate unit towards the tool upper part, the tray sealing machine additionally comprising a lifting mechanism configured to move the tray holder from a first position, at which the tray holder occupies a starting position in an open state of the sealing station, to a second position, at which the tray holder occupies a working position located closer to the tool upper part in a closed state of the sealing station, during a first predetermined motion sequence, the tray holder being adapted to be moved during the first motion sequence by means of the lifting mechanism in such a way that the tray holder will pick up the trays, which are provided on the support plate unit, at a predetermined pick-up speed, wherein the tray sealing machine is configured such that a rate of speed change over time of the tray holder will have changed from a positive value to a negative value during the first motion sequence before the tray holder has reached the predetermined pick-up speed.

17. A method of lifting and lowering a tray holder at a sealing station of a tray sealing machine, wherein, when the tray holder is being lifted, trays, which are provided on a support plate unit, are picked-up by means of the tray holder and conveyed to a tool upper part positioned above the tray holder, so as to carry out a tray sealing process, wherein the tray holder is moved by means of a lifting mechanism from a first position, at which the tray holder occupies a starting position in an open state of the sealing station, to a second position, at which the tray holder occupies a working position located closer to the tool upper part in a closed state of the sealing station, during a first predetermined motion sequence, wherein the tray holder picks up the trays, which are provided on the support plate unit, at a predetermined pick-up speed, wherein the rate of speed change over time of the tray holder changes from a positive value to a negative value during the first motion sequence before the tray holder reaches the predetermined pick-up speed.

* * * * *